United States Patent [19]

Blaese

[11] Patent Number: 5,059,971

[45] Date of Patent: Oct. 22, 1991

[54] CORDLESS ANTENNA

[76] Inventor: Herbert R. Blaese, 3314 Olcott Ave., Chicago, Ill. 60634

[21] Appl. No.: 550,324

[22] Filed: Jul. 9, 1990

[51] Int. Cl.[5] ..... H01Q 1/32

[52] U.S. Cl. ..... 343/713; 343/715; 343/882

[58] Field of Search ..... 343/715, 713, 888, 892, 343/882

[56] References Cited

U.S. PATENT DOCUMENTS 4,804,969 2/1989 Blaese ..... 343/713

FOREIGN PATENT DOCUMENTS 3205750 9/1983 Fed. Rep. of Germany ..... 343/713
3537107 4/1987 Fed. Rep. of Germany ..... 343/711
1-36128 2/1989 Japan ..... 343/711

OTHER PUBLICATIONS

Larsen Antennas advertisement, *Mobile Radio Technology* (Aug., 1990).

*Primary Examiner*—Michael C. Wimer
*Assistant Examiner*—Hoanganh Le
*Attorney, Agent, or Firm*—Gerstman & Ellis, Ltd.

[57] ABSTRACT

A cordless antenna is provided for mounting on a motor vehicle's window. The cordless antenna has an outside radiator carried by an outer RF transfer member and an inside radiator carried by an inner RF transfer member. The inside radiator is pivotally connected by means of a movable clutch to the inner RF transfer member, enabling the inside antenna to extend downwardly and in the general direction of an antenna on a portable telephone used by a person within the vehicle.

10 Claims, 3 Drawing Sheets

CORDLESS ANTENNA

FIELD OF THE INVENTION

The present invention concerns a novel antenna, and more particularly, a cordless antenna for mounting on the window of a motor vehicle.

BACKGROUND OF THE INVENTION

In U.S. Pat. No. 4,804,969, a portable antenna is disclosed which can be easily and rapidly mounted and removed from a motor vehicle's side window. The portable antenna disclosed therein utilizes a coaxial cable that couples the portable antenna to the transmitter/receiver of an installed cellular telephone within the vehicle or a hand-held portable cellular telephone used by a person within the vehicle.

I have discovered a novel antenna that obviates the need for a coaxial cable extending between the antenna and the transmitter/receiver. It is, therefore, an object of the present invention to provide an antenna that is simple in construction, efficient to manufacture and obviates the need for a coaxial cable coupled to the transmitter/receiver.

Other objects and advantages of the present invention will become apparent as the description proceeds.

SUMMARY OF THE INVENTION

In accordance with the present invention, a cordless antenna is provided for mounting on a motor vehicle's window. The antenna includes an outer RF transfer member having a first electrically conductive member on its underside for engagement with the outside of the side window. An outside radiator, adapted for location on the outside of the window, is connected to the first electrically conductive member. An inner RF transfer member is provided, having a second electrically conductive member on its underside for engagement with the inside of the window. An inside radiator, adapted to be located on the inside of the window, is connected to the second electrically conductive member. Means are provided to connect the inside radiator to the inner RF transfer member whereby the inside radiator may be positioned to extend in the general direction of an antenna on a portable telephone used by a person within the vehicle.

In the illustrative embodiments, the connecting means comprise means pivotally connecting the inside radiator to the inner RF transfer member to permit pivotal movement of the inside radiator about an axis that is substantially parallel to the window.

In one illustrative embodiment, means are provided which pivotally bridge the outer transfer member and the inner transfer member, so as to overlie the side window of the vehicle when the antenna is mounted thereon, thereby providing a portable antenna.

In an illustrative embodiment, the inside radiator is located to extend downwardly when the antenna is mounted on the side window. In this manner, the vehicle's door carrying the side window may be opened while the antenna is mounted on the side window and the inside radiator will avoid contact between the inside radiator and the door frame.

In the illustrative embodiments, the pivotal connection means comprise a movable clutch having tension control means.

A more detailed explanation of the invention is provided in the following description and claims, and as illustrated in the accompanying drawing.

DETAILED DESCRIPTION OF THE ILLUSTRATIVE EMBODIMENTS

Figure 1:
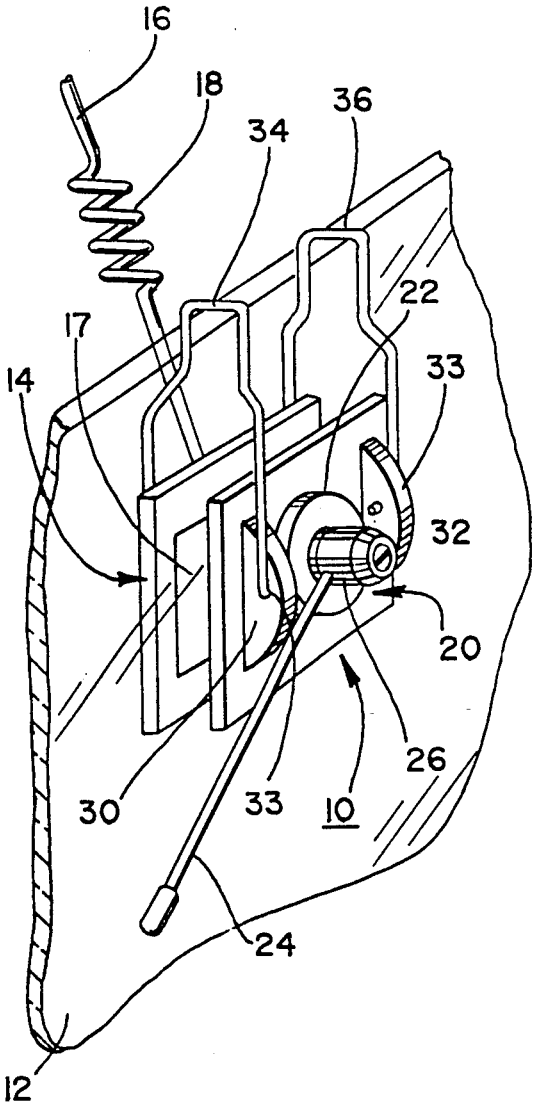
FIG. 1 is a perspective view of a portable cordless antenna constructed in accordance with the principles of the present invention.
Figure 2:
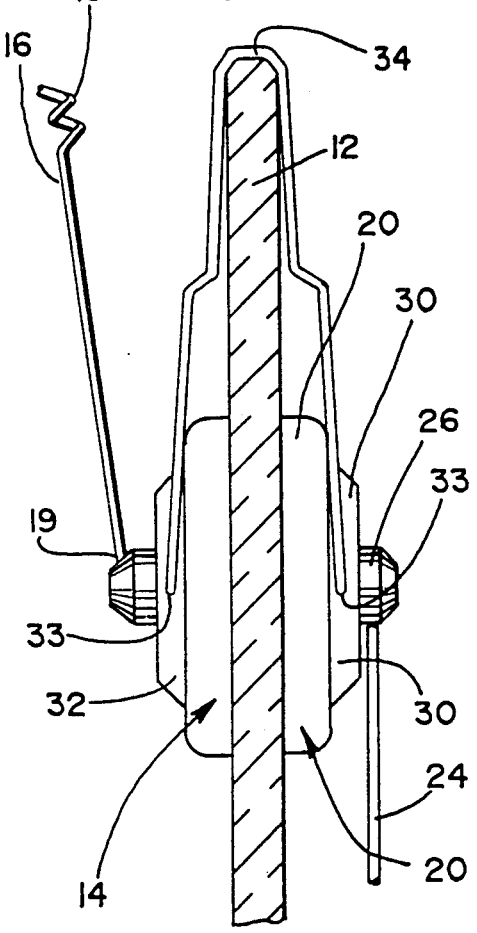
FIG. 2 is a side elevational view thereof.

The antenna of one embodiment of the present invention utilizes the principles of the on-glass portable antenna of U.S. Pat. No. 4,804,969. Referring to the figures herein, FIG. 1 shows a portable cordless antenna 10 adapted for mounting on the side window 12 of a motor vehicle. Antenna 10 comprises an outer RF transfer member 14 which includes a weather-resistant carrier formed of suitable plastic material having an electrically conductive plate 17 on its underside. In this manner, when outer RF transfer member 14 is positioned on the window 12 a illustrated in FIGS. 1 and 2, electrically conductive plate 17 will be engagement with the outside of window 12. Antenna 10 includes a radiator 16 having a loading coil 18 with its proximal end 19 connected by suitable electrically conductive connection means to conductive plate 17. For details of construction reference is hereby made to U.S. Pat. No. 4,804,969 and to other figures herein.

Outside radiator 16 is intended to be located on the outside of the side window of the vehicle, and to extend substantially vertically upward for optimum reception from cellular sites which generally radiate in a manner that a vertically upward antenna provides optimum reception.

Antenna 10 also comprises an inner RF transfer member 20 which includes a base 22 formed of a suitable plastic material and which carries a second electrically conductive plate (not shown) on its underside. When the inner transfer member 20 engages the inside of window 12, the second electrically conductive plate will be engagement with the inside of window 12.

An inside radiator 24 is pivotally connected to inner RF transfer member 20 by means of a movable clutch 26. Movable clutch 26 is constructed so as to electrically connect radiator 24 to the second electrically conductive plate which is on the underside of RF transfer member 20 and which engages the inside of window 12. In this manner, inside radiator 24 will pick up the signal from a hand held cellular phone and will act as a repeater to aid in transferring the energy from the hand held cellular phone located within the car, through window 12 to outside antenna 16.

Figure 6:
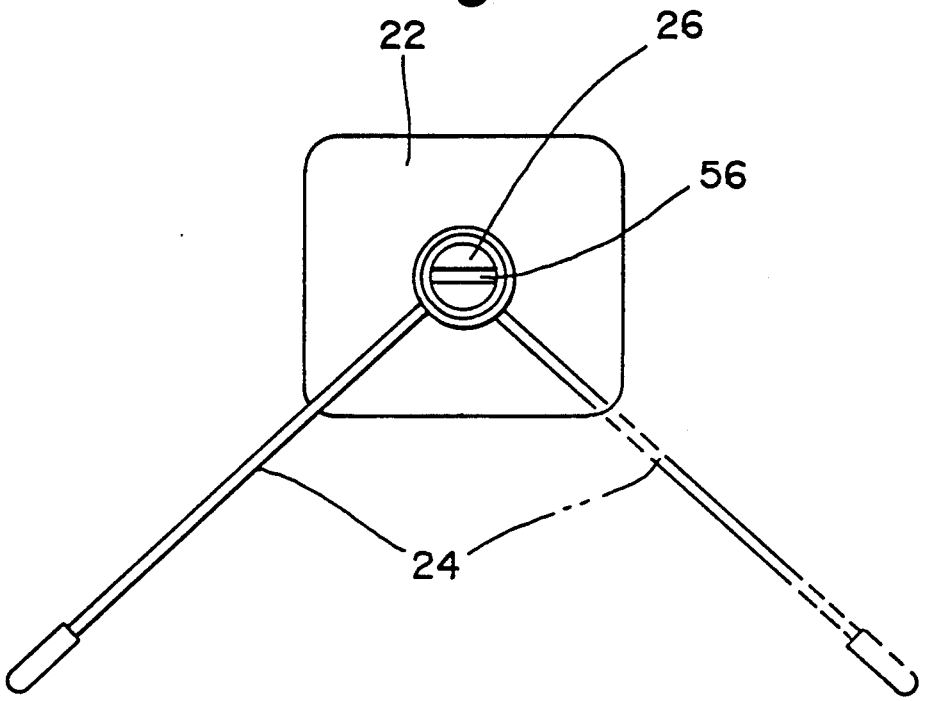
FIG. 6 is a front view of the inner transfer member and the movable clutch.

It is preferable that outside antenna 16 be mounted substantially vertically which enables it to obtain the best match to the cell site. The inside antenna 24 should be pivoted so as to be parallel with the hand held cellular phone inside the car in order to obtain the maximum transfer of energy. Thus if the cordless antenna 10 is used on the right side passenger's window, the inside radiator 24 should be angled approximately as illustrated in FIG. 1 and in full lines in FIG. 6, extending downwardly and forwardly in the vehicle so as to be parallel to the antenna of the hand held cellular phone which is being used by the passenger.

On the other hand, if the driver of the vehicle is using the hand held cellular phone, it is preferable to use the cordless antenna 10 on the left front window, on the driver's side. Inside radiator 24 will then be pivoted to extend downwardly and forwardly with respect to the left window as illustrated in dashed lines in FIG. 6, approximately 90° from the angle shown in FIG. 1. It has been found that extending inside antenna 24 at an angle of approximately 45° with respect to a vertical or horizontal plane, is satisfactory.

Transfer members 14 and 20 each include a pair of opposed journal members 30, 32, each of which defines a hole 33 for receiving a wire member. A pair of wire members 34, 36 are provided with an end of each of the wire members extending into one of the holes 33, for enabling outer transfer member 14 and inner transfer member 20 to pivot about the axis of its holes 33, which holes have a common axis. In this manner, outer transfer member 14 and inner transfer member 20 can be portably connected to window 12 by placing the outer transfer member 14 and the inner transfer member 20 on opposite sides of the side window 12 and enabling wire members 34 and 36 to bridge the transfer members. Wire members 34 and 36 are formed of spring steel and have a resistency so as to urge outer transfer member 14 and inner transfer member 20 toward each other, to be clamped against window 12, thereby providing contact of the electrically conductive members carried by the underside of the transfer members to the opposite sides of the window 12. Since outer radiator 16 is electrically connected to electrically conductive member 17 and since inner radiator 24 is electrically connected to the electrical conductive member on the underside of inner transfer member 20, RF energy is transferred through the window 12. The invention enables a rapid and effective connection of the portable cordless antenna 10 to the side window of the vehicle.

Figure 3:
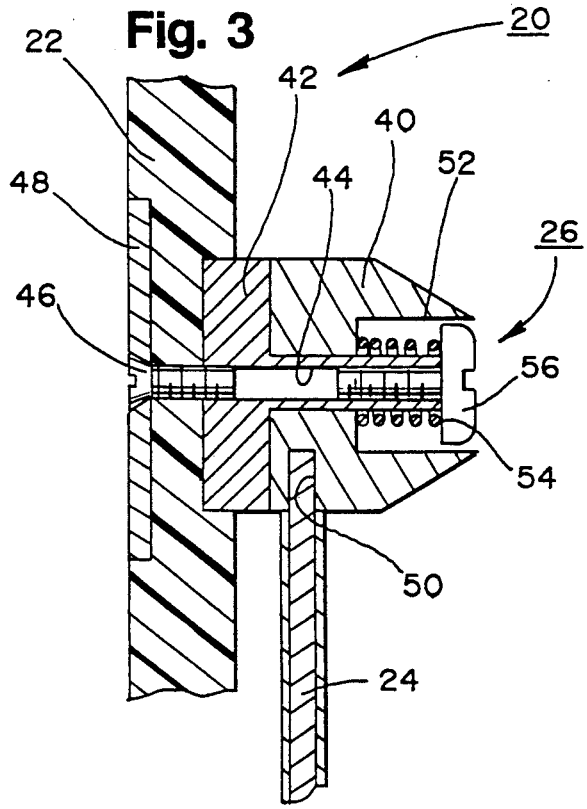
FIG. 3 is an enlarged cross-sectional view of the movable clutch of the cordless antenna of the present invention.

Movable clutch 26 is an adjustable clutch which includes a movable clutch housing 40 (FIG. 3) and a clutch stud 42 defining a threaded bore 44 into which a screw 46 extends to connect electrically conductive member 48 to the clutch housing. Clutch housing 40 and clutch stud 42 are formed of electrically conductive material with clutch housing 40 defining threaded recess 50 for receiving inside radiator 24. Inside radiator 24 is coated with a suitable plastic material.

Movable clutch housing 40 defines a central opening 52 for receiving a spring 54 and a bolt 56. Bolt 56 extends through the spring into bore 44 and as bolt 56 is turned to compress spring 54, the tension of the movable clutch will increase.

Figure 4:
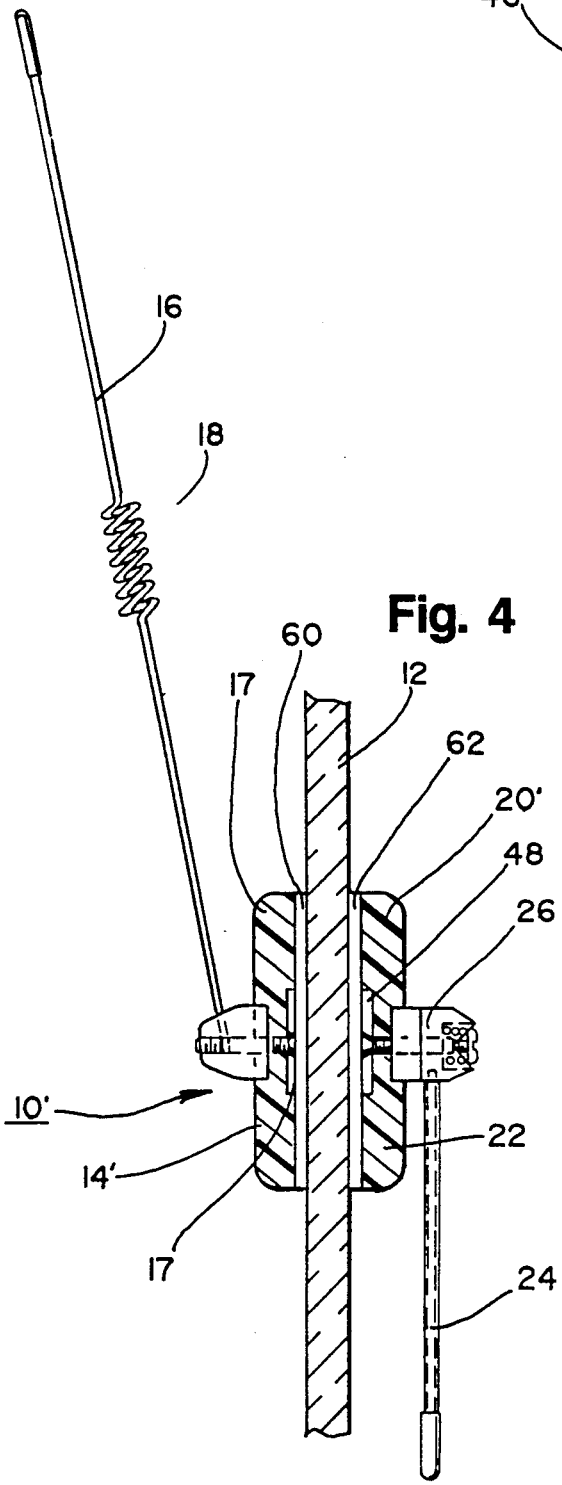
FIG. 4 is a cross-sectional view of a modified form of the cordless antenna in accordance with the principles of the present invention.
Figure 5:
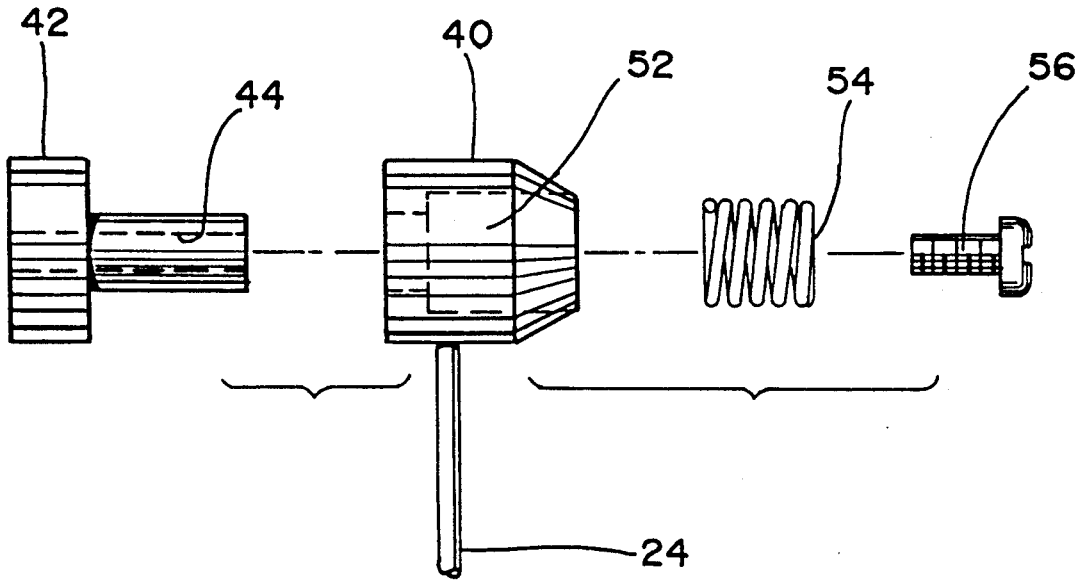
FIG. 5 is an exploded view of the movable clutch of FIG. 3.

In FIG. 4 another embodiment is shown in which a more permanent antenna 10' is mounted to the window by a suitable adhesive, such as adhesive tape. Like reference numerals are used in FIG. 4 to designate like parts from FIGS. 1–3. Outer RF transfer member 14', with electrically conductive member 17 on its underside, is affixed to window 12 by means of adhesive tape 60. Inner RF transfer 20', with electrically conductive member 48 on its underside, is affixed to the inside of the vehicle's window 12 by means of adhesive tape 62. The various structural components of antenna 10' are similar to the structural components of antenna 10, except that antenna 10' is affixed to window 12 by means of adhesive instead of being clamped onto the window as illustrated with respect to FIGS. 1 and 2.

It is seen that a novel antenna has been described which obviates the need for an electrical cable coupling the antenna to the receiver/transmitter. Although illustrative embodiments of the invention have been shown and described, it is to be understood that various modifications and substitutions may be made by those skilled in the art without departing from the novel spirit and scope of the present invention.

I claim:

1. A cordless antenna for mounting on a motor vehicle's window, which comprises:

an outer RF transfer member having a first electrically conductive member on its underside for engagement with the outside of the window;

an outside radiator adapted to be located on the outside of the window and connected to said first electrically conductive member;

an inner RF transfer member having a second electrically conductive member on its underside for engagement with the inside of the window;

an inside radiator adapted to be located on the inside of the window and connected to said second electrically conductive member; and movable connecting means for movably connecting said inside radiator to said inner RF transfer member.

2. A cordless antenna as defined by claim 1, said connecting means comprising means pivotally connecting said inside radiator to said inner RF transfer member to permit pivotal movement of said inside radiator about an axis substantially perpendicular to the window.

3. A cordless antenna as defined by claim 1, including means pivotally bridging said outer RF transfer member and said inner RF transfer member, said pivotally bridging means bridging said outer RF transfer member and said inner RF transfer member so as to overlie the side window of a vehicle when the antenna is mounted thereon.

4. A cordless antenna as defined by claim 1, said inside radiator being located so as to extend downwardly when the antenna is mounted on the window of a vehicle.

5. A cordless antenna as defined in claim 2 said movable connecting means comprising a movable clutch having tension control means.

6. A cordless antenna as defined by claim 5, said movable clutch including a clutch housing, spring means and an adjustable screw for varying compression of said spring means thereby varying the tension of the clutch.

7. A cordless antenna for mounting on a motor vehicle's side window, which comprises:

an outer RF transfer member having a first electrically conductive member on its underside for engagement with the outside of the side window;

an outside radiator adapted to be located on the outside of the side window and connected to said first electrically conductive member;

an inner RF transfer member having a second electrically conductive member on its underside for engagement with the inside of the side window;

an inside radiator adapted to be located on the inside of the side window and connected to said second electrically conductive member;

means pivotally connecting said inside radiator to said inner RF transfer member to permit pivotal movement of said inside radiator about an axis that is substantially perpendicular to the side window;

means pivotally bridging said outer RF transfer member and said inner RF transfer member, so as to overlie the side window when the antenna is mounted thereon; and said inside radiator being located so as to extend downwardly when the antenna is mounted on the side window.

8. A cordless antenna as defined by claim 7, said pivotal connection means comprising a movable clutch having tension control means.

9. A cordless antenna as defined by claim 8, said movable clutch including a clutch housing, spring means and an adjustable screw for varying compression of the spring means thereby varying the tension of the clutch.

10. A cordless antenna for mounting on a motor vehicle's side window, which comprises:

an outer RF transfer member having a first electrically conductive member on its underside for engagement with the outside of the side window;

an outside radiator adapted to be located on the outside of the side window and connected to said first electrically conductive member;

an inner RF transfer member having a second electrically conductive member on its underside for engagement with the inside of the side window;

an inside radiator adapted to be located on the inside of the side window and connected to said second electrically conductive member, said inside radiator being adapted to aid in transmitting signals to an unconnected transmitter/receiver and to aid in receiving signals from the unconnected transmitter/receiver;

movable connecting means for movably connecting said inside radiator to said inner RF transfer member; and means pivotally bridging said outer RF transfer member and said inner RF transfer member for enabling said transfer members to overlie and clamp the side window of the vehicle when the cordless antenna is mounted thereon.

* * * * *